US010806217B2

(12) United States Patent
Bock

(10) Patent No.: US 10,806,217 B2
(45) Date of Patent: Oct. 20, 2020

(54) INSOLE FOR A SHOE, IN PARTICULAR A SPORTS SHOE

(71) Applicant: PUMA SE, Herzogenaurach (DE)

(72) Inventor: Markus Bock, Herzogenaurach (DE)

(73) Assignee: PUMA SE, Herzogenaurach (DE)

( * ) Notice: Subject to any disclaimer, the term of this patent is extended or adjusted under 35 U.S.C. 154(b) by 116 days.

(21) Appl. No.: 15/999,271

(22) PCT Filed: Feb. 19, 2016

(86) PCT No.: PCT/EP2016/000296
§ 371 (c)(1),
(2) Date: Aug. 17, 2018

(87) PCT Pub. No.: WO2017/140327
PCT Pub. Date: Aug. 24, 2017

(65) Prior Publication Data

US 2019/0110554 A1 Apr. 18, 2019

(51) Int. Cl.

| | |
|---|---|
| ***A43B 17/00*** | (2006.01) |
| ***A43B 17/08*** | (2006.01) |
| ***A43B 17/10*** | (2006.01) |
| ***A43B 7/14*** | (2006.01) |
| ***A43B 17/02*** | (2006.01) |
| ***A43B 17/14*** | (2006.01) |
| *A43B 5/02* | (2006.01) |

(52) U.S. Cl.
CPC ..... *A43B 17/08* (2013.01); *A43B 7/141* (2013.01); *A43B 17/003* (2013.01); *A43B 17/006* (2013.01); *A43B 17/02* (2013.01); *A43B 17/10* (2013.01); *A43B 17/14* (2013.01); *A43B 5/02* (2013.01)

(58) Field of Classification Search
CPC ..... A43B 13/38; A43B 13/386; A43B 17/00; A43B 17/006; A43B 17/08; A43B 7/141; A43B 7/1405; A43B 7/14
USPC ..... 36/44, 43, 102
See application file for complete search history.

(56) References Cited

U.S. PATENT DOCUMENTS 955,337 A * 4/1910 Lawlor ..... A43B 11/00 36/105
1,671,713 A * 5/1928 Glass ..... A43B 7/1415 36/179

(Continued)

FOREIGN PATENT DOCUMENTS

DE 1991916 U1 2/1968

*Primary Examiner* — Marie D Bays
(74) *Attorney, Agent, or Firm* — Lucas & Mercanti, LLP; Klaus P. Stoffel

(57) ABSTRACT

An insole for a shoe, in particular for a sports shoe, having a first sole section with a standing surface for a user's foot. The first sole section extends vertically over a specified first height when the insole is used as intended. At least two second sole sections are arranged below the first sole section. A second sole section is arranged in a front section of the insole and a second sole section is arranged in a rear section of the insole viewed from the sole longitudinal direction. The two second sole sections extend over a specified second height in the vertical direction when the insole is used as intended and at least one elastic element connects the two second sole sections, each of the two ends of the elastic element engaging with a respective second sole section within the extent of the second height.

17 Claims, 2 Drawing Sheets

(56) References Cited

U.S. PATENT DOCUMENTS 1,698,003 A * 1/1929 Rieke ..... A43B 7/1465 36/179
2,779,110 A * 1/1957 Howell ..... A43B 7/1465 36/156
3,436,842 A * 4/1969 Sachs ..... A43B 23/28 36/97
4,441,499 A * 4/1984 Comparetto ..... A43B 7/1415 36/154
4,628,936 A * 12/1986 Langer ..... A43B 7/142 36/173
4,944,099 A * 7/1990 Davis ..... A43B 3/26 36/102
5,060,402 A 10/1991 Rosen
5,311,680 A * 5/1994 Comparetto ..... A43B 7/14 36/140
5,481,814 A * 1/1996 Spencer ..... A43B 7/00 36/103
5,956,868 A * 9/1999 Stevens ..... A43B 3/26 36/8.3
6,345,455 B1 * 2/2002 Greer, Jr. ..... A61F 5/14 36/145
6,804,902 B1 10/2004 McCracken
8,984,770 B1 * 3/2015 Piontkowski ..... A43B 1/0054 36/102
9,398,785 B2 * 7/2016 Horacek ..... A43B 7/32
9,918,515 B2 * 3/2018 Piontkowski ..... A43B 13/145
2002/0078591 A1 * 6/2002 Morrone ..... A43B 5/12 36/8.3
2003/0145495 A1 * 8/2003 Green ..... A43B 17/00 36/145
2006/0265900 A1 11/2006 Lin
2007/0107264 A1 * 5/2007 Meschter ..... A43B 23/227 36/76 R
2010/0218399 A1 * 9/2010 Jeong ..... A43B 7/141 36/44
2013/0104420 A1 * 5/2013 Heathcote ..... A43B 5/12 36/102
2014/0223778 A1 * 8/2014 Horacek ..... A43B 7/32 36/102
2014/0250722 A1 * 9/2014 Lin ..... A43B 7/142 36/44
2016/0073731 A1 * 3/2016 Piontkowski ..... A43B 13/145 36/102
2017/0318898 A1 * 11/2017 Totty ..... A43B 7/141

* cited by examiner

INSOLE FOR A SHOE, IN PARTICULAR A SPORTS SHOE

CROSS-REFERENCE TO RELATED APPLICATIONS

The present application is a 371 of International application PCT/EP2016/000296, filed Feb. 19, 2016, the priority of this application is hereby claimed and this application is incorporated herein by reference.

BACKGROUND OF THE INVENTION

The invention relates to an insole for a shoe, in particular for a sports shoe, comprising a first sole section, which has a standing surface for the foot of the user, wherein the first sole section extends over a specified first height in the vertical direction when the insole is used as intended.

It is well known in the state of the art to place an insole in a shoe on which the sole of foot of a user rests at intended use of the shoe. Such an insole can be designed for example as flat element made of foamed material which adapts to the inner sole, midsole or outer sole of the shoe which is arranged below the foot of the user under load by the foot of the wearer. Also possible are designs of insoles which have a three-dimensional shape and form a certain shell-shaped structure for the foot of the use.

At the use of a shoe again and again the case occurs, this is especially given in the case of soccer, that humidity enters into the shoe, wherein water can especially get in the region between the insole and the inner sole and accordingly the midsole. Specifically at soccer shoes, which get regularly moist and accordingly wet, thus the danger exists that microbes and accordingly mould are generated between the bottom of the shaft of the shoe (i. e. of the inner sole) and the insole because no sufficient venting is given.

SUMMARY OF THE INVENTION

It is the object of the invention to further develop an insole of the generic kind for use in a shoe, especially in a sports shoe, so that the drying of the shoe can take place with simple means in an improved manner. Hereby it should be provided that microbes and accordingly mould cannot be generated so easy. Thus, an improved drying effect should be obtained which can be reached with low economical expenditure.

The solution of this object by the invention is characterized in that at least two second sole sections are arranged below the first sole section, wherein a second sole section is arranged in a front section of the insole and a second sole section is arranged in a rear section of the insole viewed from the sole longitudinal direction, wherein the two second sole sections extend over a specified second height in the vertical direction when the insole is used as intended, wherein at least one elastic element is present, which connects the two second sole sections, wherein each of the two ends of the elastic element engaging with a respective second sole section within the extent of the second height.

The at least one elastic element extends thereby preferably in longitudinal direction of the sole.

The at least one elastic element is preferred designed as rubber strap what is beneficial under economical aspects because such straps are available low priced. The rubber strap is thereby preferably designed as flat band. In this case it is preferably provided that the height of the rubber strap is at most 30%, preferably at most 20%, of the width of the rubber strap.

According to a preferred embodiment of the invention two parallel running elastic elements are arranged.

The at least one elastic element can adjoin to the first sole section in the region of its ends.

The two second sole sections are preferably arranged at the insole in such a manner that they leave between another a region which is free from a second sole section. Hereby it can be provided that the bending stiffness of the first sole section around a horizontal axis transverse to the longitudinal direction of the sole is selected so small that the at least one elastic element deforms the insole V-shaped without outer forces onto the insole. Thereby it is sufficient when a position is taken at which the two legs of the V-shaped structure (seen in the side view) include an angle of about 1600.

The second sole section which is arranged in the front section can extend preferably at least along one third of the extension of the longitudinal direction of the sole. Especially the second sole section which is arranged in the rear section can extend at least along one quarter of the extension of the longitudinal direction of the sole.

The first sole section and the second sole sections are preferably designed as separate parts which are connected, especially glued, with another. Hereby it can be provided that the second sole sections consist of a plane material of substantial constant thickness. Furthermore it was proven that the second sole sections consist of a foamed material which is provided with a plurality of venting recesses.

The first sole section is designed according to a special embodiment of the invention as 3-dimensional part with shell-shaped heel region. Herefrom it results that naturally the vertical height of the first sole section needs not at all to be constant along the longitudinal direction of the sole.

Thus, according to the invention an elastic element (spring element, preferably in the form of a rubber strap) is used which is arranged and accordingly integrated at or into the insole in such a manner that at non-use of the shoe and thus at freedom of the insole from outer forces the same can arch upwards so that it takes off from the inner sole, midsole and accordingly outer sole and allows the entry of air for the purpose of drying of the shoe.

Due to the weight of the wearer of the shoe the insole lies on the inner sole, midsole and accordingly outer sole at intended use of the shoe and the insole respectively so that no influence of the use of the shoe is given.

The proposed insole thus causes that an opening between the bottom sole element and the insole for fresh air is formed after taking off of the shoe which promotes the drying process substantially.

The proposed insole is used preferably in a sports shoe, wherein especially a soccer shoe is considered which is often exposed to humidity. To obtain an improved drying effect the idea according to the invention thus provides that the insole is biased by means of a spring element in such a manner that the same lifts off automatically after taking off the shoe and thus the region between insole and inner sole is laid open at least partially. Present humidity in this region can evaporate in a better way. That means by the elastic element the insole can arch upwards. Beneficially, a drying of the bottom side of the insole as well as the bottom of the shaft of the shoe takes place in a substantial easier manner.

BRIEF DESCRIPTION OF THE DRAWING

In the drawing an embodiment of the invention is shown.

DETAILED DESCRIPTION OF THE INVENTION

Figure 1:
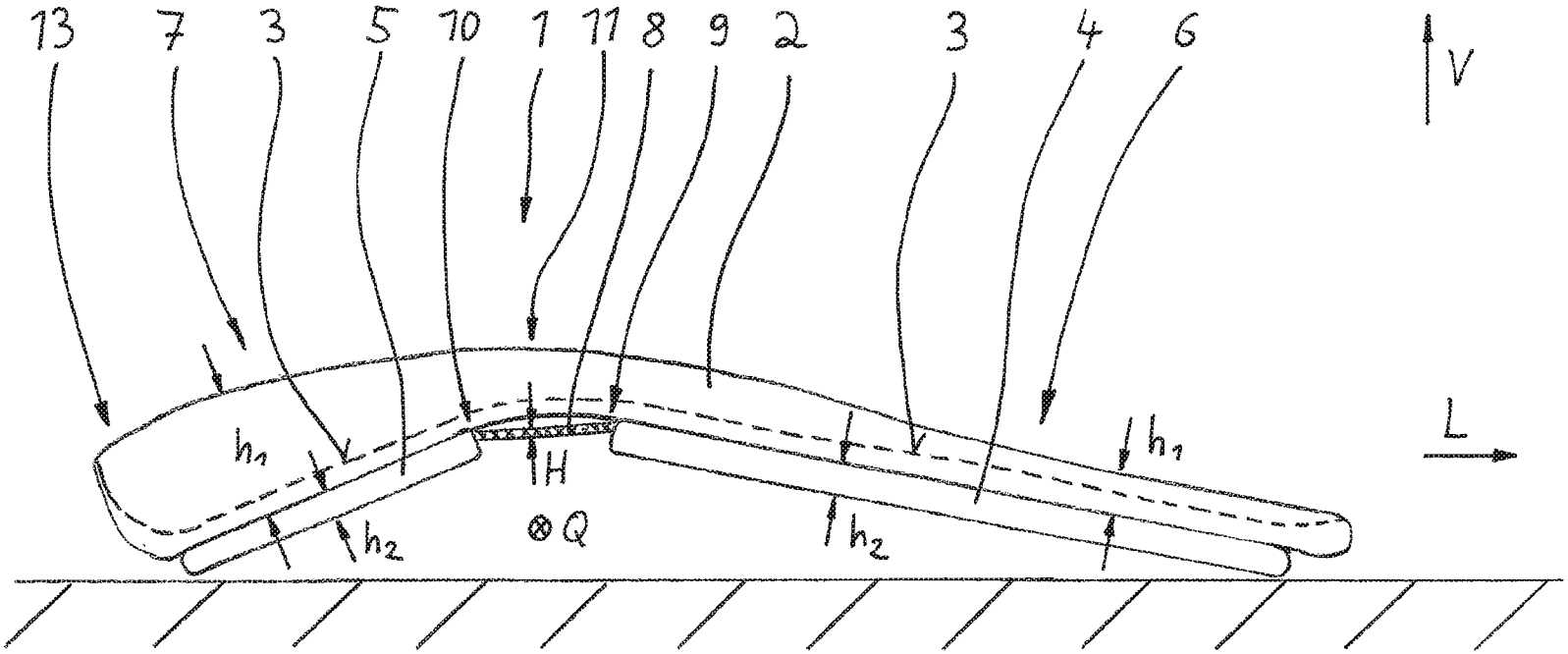
FIG. 1 shows the side view of an insole, wherein the same lies on the ground and is free from outer forces

In the figures an insole 1 is shown which can be used in a shoe, especially in a sports shoe. The insole 1 has a first continuous designed first sole section 2, which comprises a standing surface 3 for the foot sole of the wearer. At the bottom side of the first sole section 2 two second sole sections 4 and 5 are arranged. One of the second sole sections 4 is positioned in the front section 6 of the insole 1; the other second sole section 5 is arranged in the rear section 7 of the insole 1.

The two sole sections 4 and 5 are separate form parts which are arranged at the bottom side of the first sole section 2; thereby the two second sole sections 4 and 5 are concrete glued at the bottom side of the first sole section 2.

The first sole section 2 has a first height $h_1$ which is variable along the longitudinal direction L of the sole. The height $h_1$ is the extension in vertical direction V which is measured when the insole 1 is used as intended (and thus lies plane on the ground). However, in FIG. 1 the state is shown which is given for the insole 1 when the same is free from outer forces. As can be seen in this case the insole takes an approximate V-shaped contour—seen in the side view according FIG. 1—so that it is arched upwards and allows in the meaning of the above given explanations that air can reach under the insole 1 and can so contribute to an improved drying of the shoe in which the insole 1 is used.

In order to provide that said arching upwards occurs in the case of freedom from outer forces elastic elements 8 are effectively arranged between the two second sole sections 4 and 5 which make sure that the two second sole sections 4 and 5 are contracted in the longitudinal direction L of the sole. The elastic elements 8 are provided to connect the two second sole sections 4 and 5 with another, wherein the elastic elements 8 are engaged with their two ends 9 and 10 within the extension of the second height $h_2$ each at the two second sole sections 4 and 5. So it is provided that at missing outer forces the shape as shown in FIG. 1 is taken by the insole 1.

Figure 2:
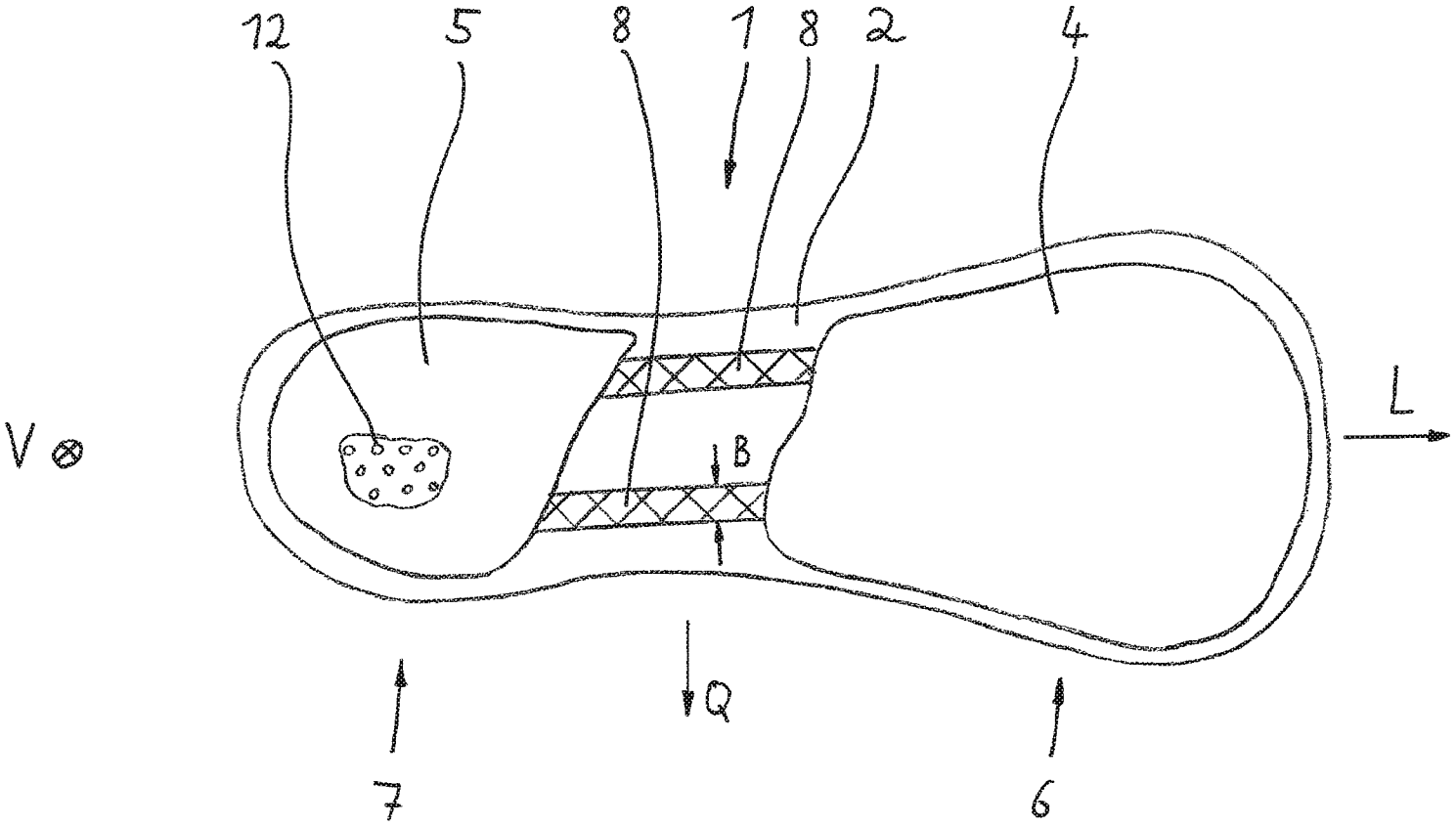
FIG. 2 shows the view of the insole according to FIG. 1 seen from the bottom.

As can be seen in the synopsis of FIGS. 1 and 2 the two elastic elements 8 are designed in the embodiment as rubber straps which affect with their ends 9 and 10 respectively the two sole sections 4 and 5 respectively. Between the two sole sections 4 and 5 a free region 11 remains in which only the two elastic elements 8 are arranged.

As can be seen from FIG. 1 the first sole section 2 has, as already mentioned, a first height $h_1$ which however is not constant along the longitudinal direction L as can be seen immediately from FIG. 1. Meanwhile the two second sole sections 4 and 5 have in the embodiment a constant second height $h_2$.

As can be seen from FIG. 1 the elastic elements 8 affect in the embodiment in the transition region between the first sole section 2 and the respective second sole section 4 and 5 and developed between their ends 9 and 10 a tension force.

The same is created due to the realisation of the elastic elements 8 as rubber straps with a height H and a width B as becomes apparent from FIG. 2.

The first sole section 2 is presently designed as 3-dimensional form part which in fact has a substantial plane shape in the forefoot region, which however has a shell-shaped heel region 13 in the rearfoot region.

The two second sole sections 4 and 5 have substantially to a large extent a plane base contour and consist in the embodiment of a foamed material which is provided with a plurality of venting recesses 12; this is illustrated in FIG. 2 for a small section in the second sole section 5.

By the explained concept it is achieved that due to the two elastic elements 8 a bending torque is created which acts around the axis Q transverse to the longitudinal direction L of the sole and that the insole 1 is brought into the depicted form according to FIG. 1 in the case that no outer forces act on the same, i. e. the insole 1 arches upwards and allows the entry of air in the region between the bottom side of the insole 1 and the (not depicted) inner sole, midsole or outer sole on which it lies at intended use.

By doing so an insole 1 is created which can be produced in a cost efficient manner and which allows an improved drying of the same at non-use of the shoe in which it is used.

LIST OF REFERENCES

1 Insole
2 First sole section
3 Standing surface
4 Second sole section
5 Second sole section
6 Front section of the insole
7 Rear section of the insole
8 Elastic element
9 End of elastic element
10 End of elastic element
11 Free region
12 Venting recess
13 Shell-shaped heel region
$h_1$ First height
$h_2$ Second height
H Height of the elastic element
B Width of the elastic element
V Vertical direction
L Longitudinal direction of the sole
Q Axis transverse to the longitudinal direction of the sole

The invention claimed is:

1. An insole for a shoe, comprising a first sole section, which has a standing surface for the foot of the user and extends over an entire length of the foot, wherein the first sole section extends over a specified first height in the vertical direction when the insole is horizontal, wherein at least two second sole elements are attached to a bottom of the first sole section, wherein a second sole element is arranged in a front section of the insole and a second sole element is arranged in a rear section of the insole viewed from longitudinal direction of the insole, wherein the two second sole elements extend over a specified second height in the vertical direction when the insole is horizontal, wherein at least one elastic element is provided only below the first sole section and connects the two second sole elements, wherein the elastic element has two ends, each of the two ends of the elastic element engaging with a respective second sole element within the extent of the second height so that the at least one elastic element creates a bending force that acts around an axis transverse to the longitudinal direction of the insole, wherein the insole arches upward when no outer forces act on the insole and allows an entry of air in a region between a bottom side of the insole and an inner sole, a midsole or an outer sole on which the insole lies during use.

2. The insole according to claim 1, wherein the at least one elastic element extends in longitudinal direction of the sole.

3. The insole according to claim 1, wherein the at least one elastic element is designed as rubber strap.

4. The insole according to claim 3, wherein the rubber strap is designed as flat band.

5. The insole according to claim 4, wherein the height of the rubber strap is at most 30% of the width of the rubber strap.

6. The insole according to claim 1, wherein two parallel running elastic elements are arranged.

7. The insole according to claim 1, wherein the at least one elastic element adjoins to the first sole section in a region of the two ends.

8. The insole according to claim 1, wherein the two second sole elements are arranged at the insole in such a manner that they leave between another a region which is free from a second sole element.

9. The insole according to claim 8, wherein the first sole section is configured to have a bending stiffness around a horizontal axis transverse to the longitudinal direction of the insole so small that the at least one elastic element deforms the insole V-shaped without outer forces onto the insole.

10. The insole according to claim 1, wherein the second sole element which is arranged in the front section extends at least along one third of the extension of the longitudinal direction of the insole.

11. The insole according to claim 1, wherein the second sole element which is arranged in the rear section extends at least along one quarter of the extension of the longitudinal direction of the insole.

12. The insole according to claim 1, wherein the first sole section and the second sole elements are designed as separate parts which are connected with another.

13. The insole according to claim 12, wherein the second sole elements consist of a plane material of substantial constant thickness.

14. The insole according to claim 12, wherein the second sole elements consist of a foamed material which is provided with a plurality of venting recesses.

15. The insole according to claim 1, wherein the first sole section is designed as 3-dimensional part with a cupped heel region.

16. The insole according to claim 5, wherein the height of the rubber strap is at most 20% of the width of the rubber strap.

17. The insole according to claim 12, wherein the first sole section and the second sole elements are glued with another.

* * * * *